US007669661B2

(12) United States Patent
Johnson

(10) Patent No.: US 7,669,661 B2
(45) Date of Patent: Mar. 2, 2010

(54) THERMALLY EXPANSIVE FLUID ACTUATOR DEVICES FOR DOWNHOLE TOOLS AND METHODS OF ACTUATING DOWNHOLE TOOLS USING SAME

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 42 days.

(21) Appl. No.: 12/214,584

(22) Filed: Jun. 20, 2008

(65) Prior Publication Data

US 2009/0314497 A1 Dec. 24, 2009

(51) Int. Cl.
*E21B 34/06* (2006.01)

(52) U.S. Cl. ..... 166/373; 166/57

(58) Field of Classification Search ..... 166/373, 166/57, 381, 302
See application file for complete search history.

(56) References Cited

U.S. PATENT DOCUMENTS

| | | | | |
|---|---|---|---|---|
| 3,430,440 | A * | 3/1969 | Pouliot | 60/530 |
| 5,709,740 | A | 1/1998 | Haider et al. | |
| 6,695,061 | B2 * | 2/2004 | Fripp et al. | 166/373 |
| 7,019,269 | B2 * | 3/2006 | Okuda | 219/544 |
| 7,032,675 | B2 * | 4/2006 | Steele et al. | 166/373 |
| 2008/0236840 | A1 * | 10/2008 | Nguy | 166/377 |
| 2009/0183879 | A1 * | 7/2009 | Cox | 166/302 |

FOREIGN PATENT DOCUMENTS

WO WO 2006135565 A2 * 12/2006

* cited by examiner

*Primary Examiner*—Daniel P Stephenson
(74) *Attorney, Agent, or Firm*—Greenberg Traurig LLP; Anthony F. Matheny

(57) ABSTRACT

An actuator device for setting a downhole tool is disclosed. The actuator device comprises a thermally expansive fluid within a chamber. Application of heat to the thermally expansive fluid causes the thermally expansive fluid to expand. In so doing, pressure within the chamber increases causing the downhole tool to be actuated such as by the thermally expansive fluid applying pressure directly to the actuating member or indirectly by allowing hydrostatic wellbore pressure to be allowed to act directly with the actuating member.

17 Claims, 3 Drawing Sheets

THERMALLY EXPANSIVE FLUID ACTUATOR DEVICES FOR DOWNHOLE TOOLS AND METHODS OF ACTUATING DOWNHOLE TOOLS USING SAME

BACKGROUND

1. Field of Invention

The invention is directed to actuator devices for actuating downhole tools and, in particular, actuator devices having a thermally expansive fluid that, when expanded causes actuation of the downhole tool.

2. Description of Art

Some downhole tools need to be retained in an unset position until properly placed in the well. It is only when they are properly located within the well that the downhole tool is set through actuation of the tool. One technique for actuating the downhole tool is to open a window or passageway within the downhole tool exposing the actuating member, e.g., piston, of the downhole tool to the wellbore environment, e.g., the hydrostatic wellbore pressure. The hydrostatic pressure then acts upon the actuating member of the downhole tool and the downhole tool is actuated. In this technique, the creation of the window or passageway does not directly actuate the downhole tool. Instead, the creation of the window or passageway allows a different actuating mechanism, e.g., the hydrostatic or wellbore pressure, to actuate the tool. Additionally, in some instances, hydrostatic pressure is insufficient to actuate the tool.

In other techniques, pressures from fluids pumped down the well are used to actuate the downhole tools. In still another technique, an explosive charge is included as part of the downhole tool. The explosive charge is then detonated by a detonator connected to the surface of the well through an electronic line or connected to battery pack located on the downhole tool. The force from the combustion of the explosive change then acts upon the actuating member and the downhole tool is actuated.

SUMMARY OF INVENTION

Broadly, the actuator devices for downhole tools comprise a housing or body, an actuating member, and a thermally expansive fluid that is expandable by applying heat to the thermally expansive fluid. In certain embodiments, the downhole tools include a retaining member such as a shear pin or chambers having equalized pressures. The retaining member prevents movement of the actuating member until the expansion of the thermally expansive fluid is sufficient to allow a high enough pressure to act on the actuating member and, thus, actuate the tool. In one specific embodiment, expansion of the thermally expansive fluid is accomplished by heating the thermally expansive fluid with a thermoelectric device, such as one having a heating coil. In another specific embodiment, expansion of the thermally expansive fluid is accomplished by a thermally conductive material, such as aluminum, pulling heat from the wellbore environment and transferring that heat to the thermally expansive fluid. As the pressure within the downhole tool increases, due to the continued expansion of the thermally expansive fluid, the retaining member is no longer capable of preventing the movement of the actuating member. As a result, the actuating member moves and, thus, sets the downhole tool.

In certain specific embodiments, the expansion of the thermally expansive fluid sets the downhole tool by one or more of freeing a piston to move or by any other mechanism known to persons skilled in the art. Moreover, in some embodiments, the expansion of the thermally expansive fluid directly sets the tool. Alternatively, the expansion of the thermally expansive fluid may assist another setting mechanism, such as use of drilling fluid pressure or hydrostatic pressure, in setting the downhole tool.

Thus, actuator devices and methods disclosed herein not only permit actuation of the downhole tool, but actively assist in the actuation of the downhole tool through the expansion of a thermally expansive fluid. Therefore, the pressure from the expansion of the thermally expansive fluid, either alone or in combination with any other actuation mechanism known to persons skilled in the art, plays an active role in actuation of the downhole tool. The thermally expansive fluid may be any fluid known to persons of ordinary skill in the art.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
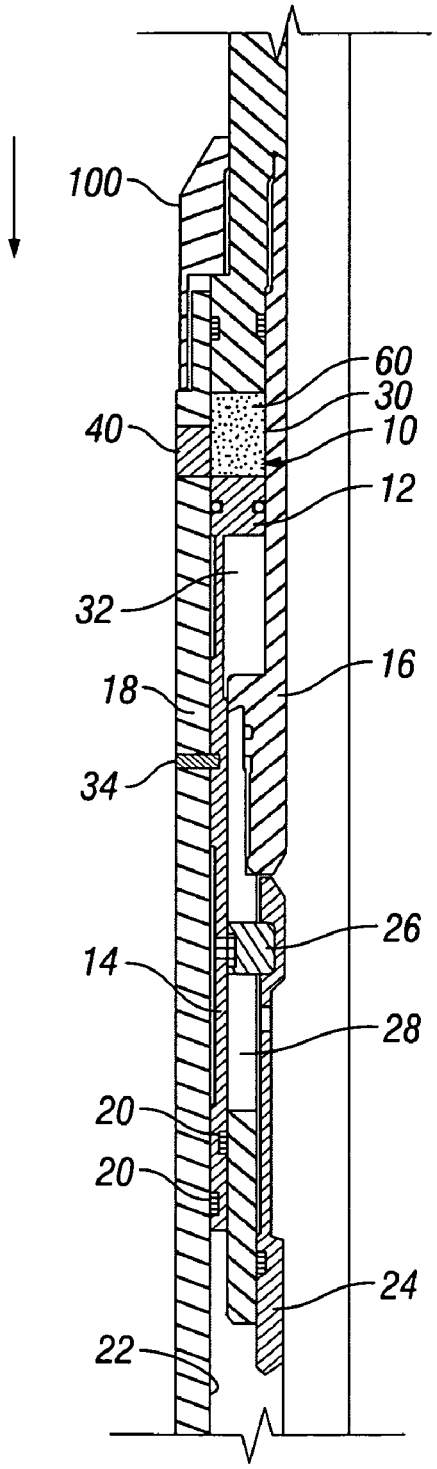
FIG. 1 is a cross-sectional view of one specific embodiment of the actuator device shown in its initial or run-in position
Figure 2:
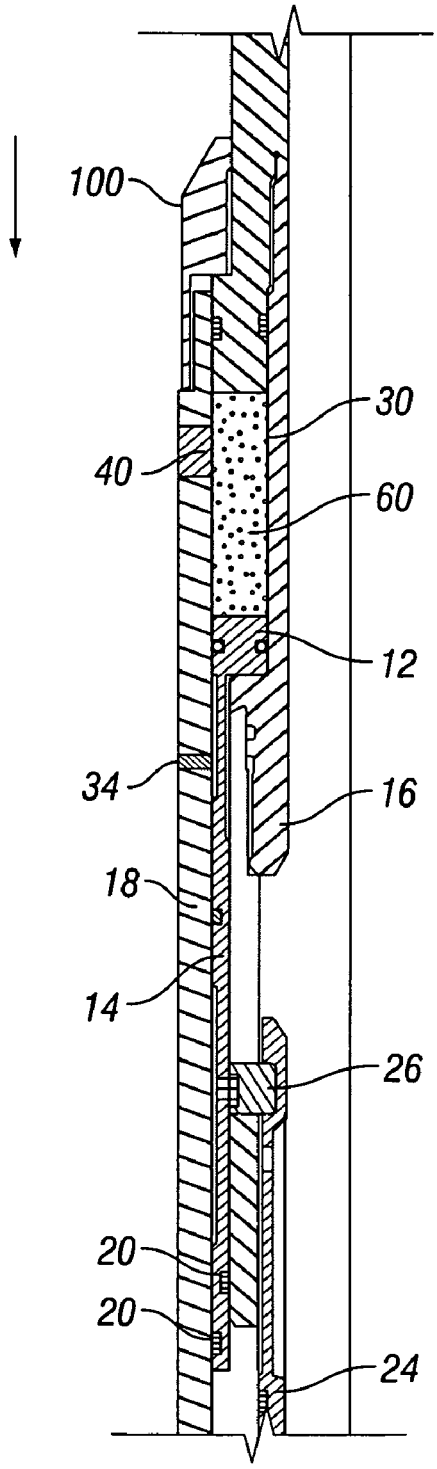
FIG. 2 is a cross-sectional view of the actuator device of FIG. 1 shown in its actuated position.

Referring now to FIGS. 1-5, in one embodiment, actuator device 10 is included as part of downhole tool 100. Downhole tool 100 is lowered on a string of conduit, e.g., tools string, into the well and may be used for setting a packer, a bridge plug, or various other functions. Actuator device 10 has an actuating member, which as shown in FIGS. 1-2, is piston 12. Generally, movement of piston 12 sets downhole tool after it is properly located in a well (not shown). As shown in FIG. 1, piston 12 is in its initial or "run-in" position. The initial position is the position prior to actuation of downhole tool 100. FIG. 2 shows piston 12 in the actuated position.

In the specific embodiment of FIGS. 1-2, piston 12 includes a depending sleeve 14 carried in an annular chamber around a central mandrel assembly 16 of tool 100 and within a housing 18 of tool 100. Sleeve 14 has inner and outer seals 20 that slidably engage mandrel assembly 16 and the inner side wall of housing 22 when actuated. Sleeve 14 of piston 12 is connected to an actuating element 24 by key 26 extending through an elongated slot 28 in mandrel assembly 16 to move actuating element 24 downward when piston 12 moves downward. Actuating element 24 performs a desired function, such as setting a packer. When actuated, a force is applied to piston 12 in the direction of the arrow. As disclosed herein, the force is created, at least in part, by the build-up of fluid pressure within upper chamber 30 from the expansion of thermally expansive fluid 60 contained within chamber 30. Additionally, the force can come from a variety of other sources operating in combination with the fluid pressure from the expansion of thermally expansive fluid 60. These other sources include hydrostatic pressure, fluid pressure pumped from the surface, or various springs or other energy storage devices or equivalents. When applied, the force moves piston 12 and sleeve 14 in the direction of the arrow.

Actuator device 10 also includes lower chamber 32, which is located on the opposite side of piston 12 from upper chamber 30. In one embodiment, the pressure within upper chamber 30 and lower chamber 32 maintain, or retain, piston 12 in the run-in position until the expansion of thermally expansive fluid 60 contained within upper chamber 30. In one embodiment, the pressure within upper chamber 30 is equalized with the pressure in lower chamber 32 during run-in. Actuator device 10 would normally be connected to a device (not shown) being set, such as a packer, which would provide resistance to movement of piston 12 during run-in. In a specific embodiment, shear pin 34 maintains, or retains, piston 12 in the run-in position until the expansion of thermally expansive fluid 60 within upper chamber 30. Shear pin 34 is secured between sleeve 14 and housing 18. If shear pin 34 is employed, the pressures in upper chamber 30 and lower chamber 32 can differ during run-in.

At least a portion of upper chamber 30 is filled with thermally expansive fluid 60. In the specific embodiment shown in FIG. 1, the entire volume of upper chamber 30 is filled with thermally expansive fluid 60. The term "thermally expansive fluid" as used herein means that the fluid is capable of expansion upon being heated. In other words, the volume of the thermally expansive fluid is increased by an increase in the temperature of the thermally expansive fluid. In particular embodiments, the thermally expansive fluid comprises a high co-efficient of expansion so that sufficient expansion of the thermally expansive fluid can occur at desired temperature ranges.

The thermally expansive fluid may be any fluid known to persons of ordinary skill in the art that is capable of expansion. In one specific embodiment, the thermally expansive fluid comprises an expandable wax such as those disclosed in U.S. Pat. No. 5,709,740, which is hereby incorporated herein in its entirety.

It is to be understood that the apparatuses and methods disclosed herein are considered successful if the thermally expansive fluid expands sufficiently within upper chamber 30 such that the actuating member, e.g., piston, is ultimately moved from its initial or "run-in" position to its actuated or "setting" position so that the downhole tool is set. In other words, the apparatuses and methods are effective even if all of the thermally expansive fluid does not reach its maximum expansion. In one specific embodiment, the thermally expansive fluid expands to a volume that is at least 20% greater than its initial volume before being heated. In other specific embodiment, the thermally expansive fluid expands to a volume that is at least 50% greater than its initial volume before being heated.

It is also to be understood that the pressure from the expansion of thermally expansive fluid may assist another setting mechanism, such as use of drilling fluid pressure or hydrostatic pressure, in setting the downhole tool. For example, as discussed below with respect to the embodiments of FIGS. 4-5, the expansion of the thermally expansive fluid may rupture a rupture disk or other membrane that permits hydrostatic fluid in the wellbore to then actuate the actuating member. Accordingly, as long as the downhole tool is set through the assistance of the expansion of the thermally expansive fluid, either alone or in conjunction with another setting mechanism, the apparatuses and methods disclosed herein are considered successful.

Still with reference to FIG. 1, in this specific embodiment, actuator device 10 comprises heating source 40. Heating source 40 may be any component capable of transmitting heat to thermally expansive fluid 60. For example, heating source 40 may be a thermoelectric device that is electronically controlled at the surface of the well through known methods and devices. Upon activation of the thermoelectric device, heat is generated by the thermoelectric device and the generated heat is transferred to thermally expansive fluid 60 causing thermally expansive fluid 60 to be heated and, thus, expanded. Alternatively, heating source 40 may be activated by the wellbore fluid itself such as where heating source 40 is a thermally conductive material such as aluminum that is heated by the wellbore environment and the heated thermal conductive material in turn heats thermally expansive fluid 60. In yet another embodiment, heating source 40 is activated through the use of flow alternator or generator that is activated by the flow of the wellbore fluid so that electricity is generated to heat thermally expansive fluid 60.

Figure 3:
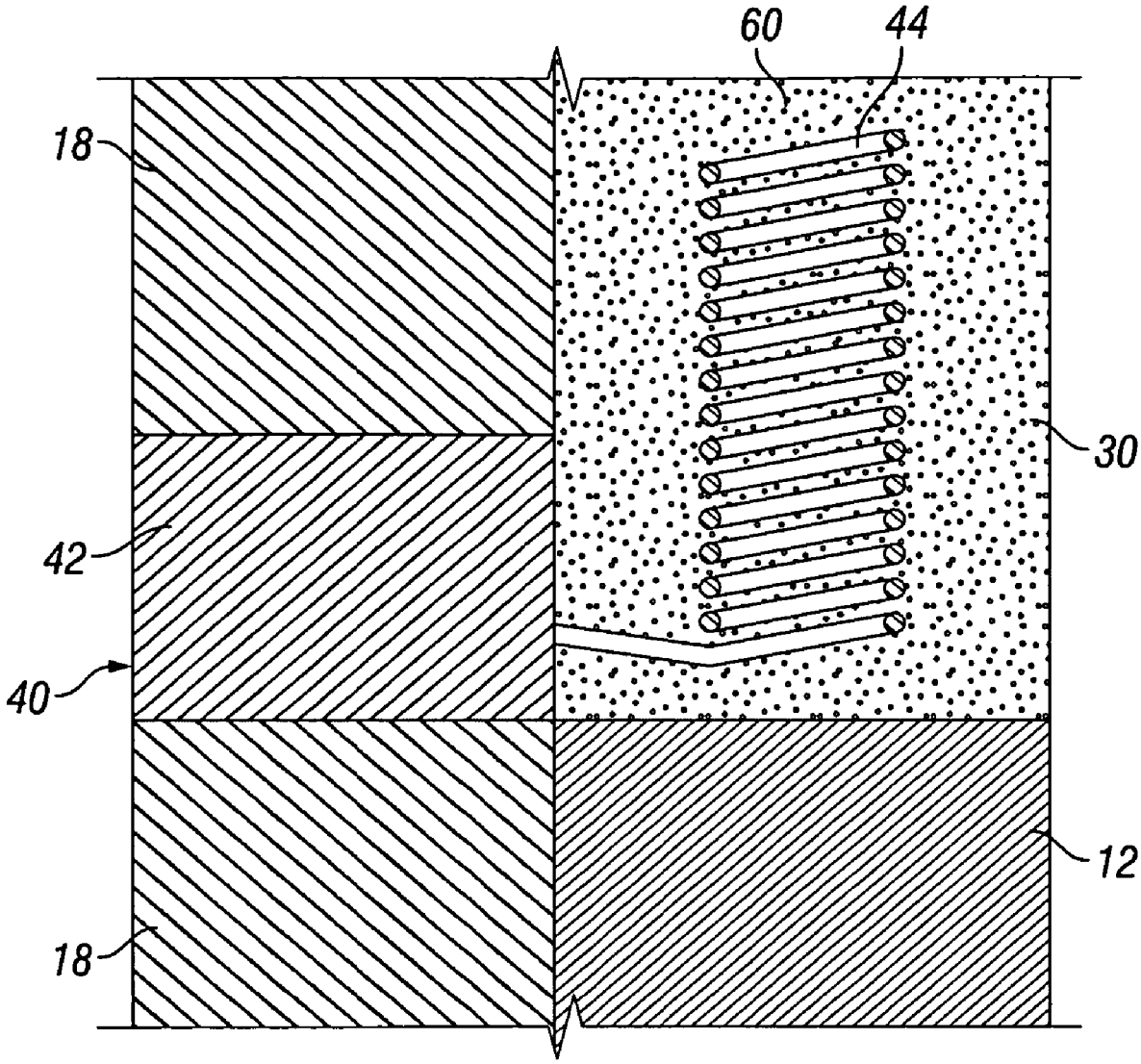
FIG. 3 is a cross-sectional view of an additional specific embodiment of the actuator device.

As illustrated in FIG. 3, heat source 40 comprises thermoelectric device 42 having heating element such as heating coil 44 disposed within upper chamber 30 and in contact with thermally expansive fluid 60. Electricity is flowed through thermoelectric device 42 in the same manner as other downhole tools known in the art. The flow of the electricity activates heating coil 44 so that heat is generated by heating coil 44. This heat from heating coil 44 is transferred to thermally expansive fluid 60 causing thermally expansive fluid 60 to expand and, thus, force piston 12 downward.

Figure 4:
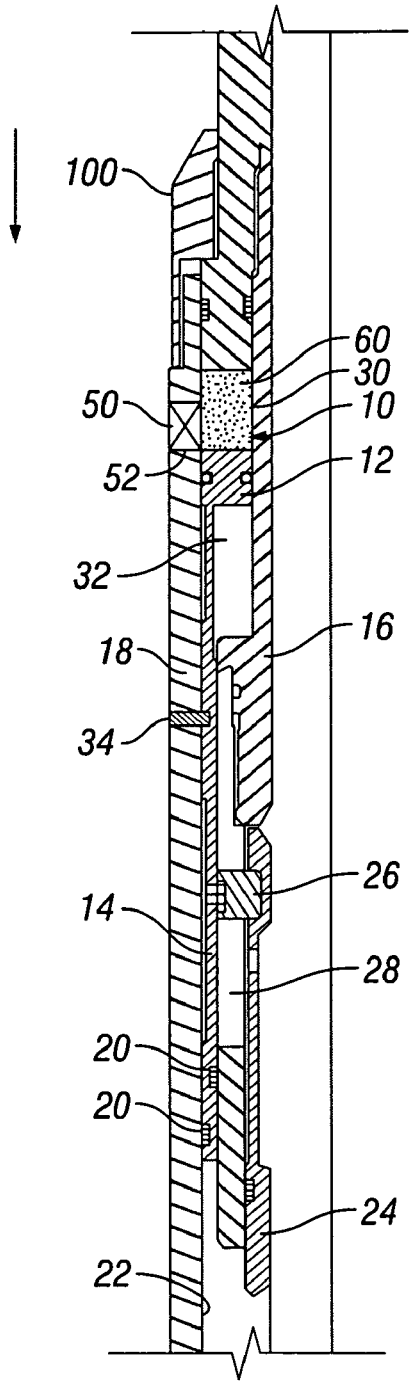
FIG. 4 is a cross-sectional view of another specific embodiment of the actuator device shown in its initial or run-in position.
Figure 5:
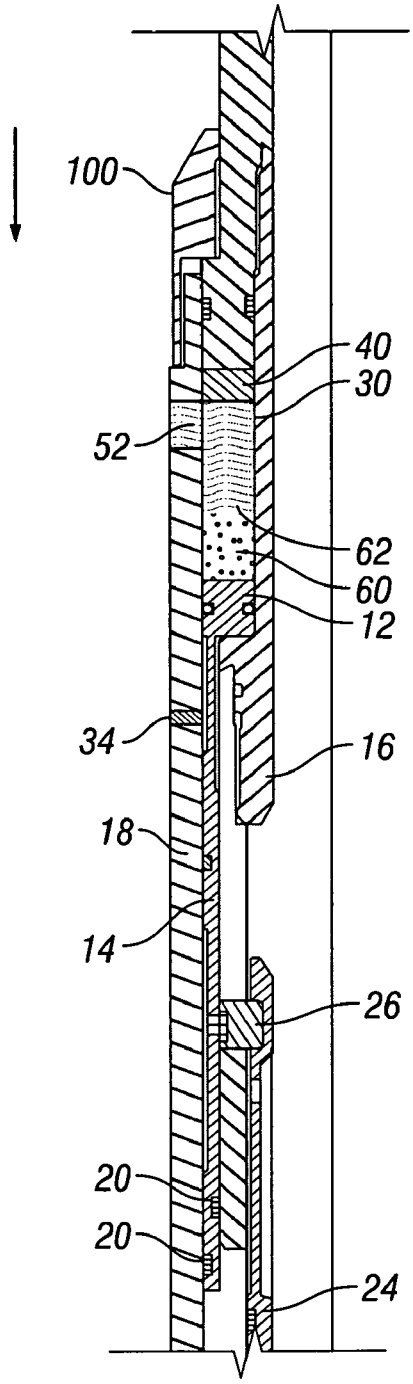
FIG. 5 is a cross-sectional view of the actuator device of FIG. 4 shown in its actuated position.

Referring now to FIGS. 4-5, in another specific embodiment, downhole tool 100 includes a membrane such as rupture disk 50 that is designed to break-away at predetermined pressures due to pressure being applied to the membrane by the expansion of thermally expansive fluid 60. Membranes such as rupture disks 50 are known in the art. Passageway 52 contains rupture disc 50 and is in fluid communication with upper chamber 30. In these embodiments, breaking the membranes such as rupture disk 50 allows wellbore fluid 62 (FIG. 5) to enter into passageway 52 and into upper chamber 30 and to force thermally expansive fluid 60 into the upper surface of piston 12 which, in turn, forces piston 12 downward.

Although passageway 52 is shown horizontally disposed within housing 18, passageway 52 may be disposed at an angle such that the intersection of passageway 52 with the wellbore environment is lower than the intersection of passageway 52 with upper chamber 30.

In one specific embodiment, not shown, an actuatable valve placed within passageway 52 may be opened to let wellbore fluid 62 from the wellbore into passageway 52 and, thus, into upper chamber 30 to actuate piston 12. The valve is operatively associated with thermally expansive fluid 60 such that expansion of thermally expansive fluid 60 actuates the valve to open the valve and allow wellbore fluid 62 to act on the actuating member, e.g., piston 12. The valve may be any valve known in the art. Inclusion of the valve in passageway 52 could be advantageous in applications where expansion of thermally expansive fluid 60 is insufficient to actuate piston 12, but is sufficient to actuate a valve to allow the hydrostatic pressure, which is sufficient to actuate piston 12, to enter upper chamber 30 to actuate piston 12.

In one operation, downhole tool 100 is lowered into a well (not shown) containing a well fluid by a string (not shown) of conduit attached to mandrel assembly 16. After disposing downhole tool 100 at the desired location, thermally expansive fluid 60 is expanded such as through application of heat to thermally expansive fluid 60. Expansion of thermally expansive fluid 60 either directly or indirectly causes the actuating member of downhole tool 100 to be actuated so that a downhole operation, such as setting a packer, is performed.

In one particular embodiment of the method of operation, the portion of piston 12 above seals 20 and the portion below seals 20 are isolated from the wellbore fluid during run-in so that the pressure on the upper and lower sides of seals 20 is at atmospheric. Likewise, the pressure in upper chamber 30 and lower chamber 32 is also atmospheric. After disposition of downhole tool 100 at the desired location, thermally expansive fluid 60 is expanded such as by applying heat to thermally expansive fluid using thermoelectric device. As the thermally expansive fluid expands, the pressure within upper chamber 30 increases and exerts a downward force on piston 12 because the pressure in lower chamber 32, as well as below seals 20, i.e., is atmospheric. As a result, actuating element 24, e.g., piston 12, moves downward and actuates downhole tool 100 by moving actuating element 24 downward to the position shown in FIG. 2. If shear pin 34 is employed, the pressure build-up in upper chamber 30 would be sufficient to cause it to shear.

In another embodiment of the methods of operation of downhole tool 100, expansion of thermally expansive fluid 60 causes rupture disk 50 to break so that wellbore fluid flows through passageway 52 into upper chamber 30. Hydrostatic pressure from the wellbore environment increases the pressure within upper chamber 30 which exerts a downward force on piston 12 because the pressure in lower chamber 32, as well as below seals 20, i.e., is atmospheric. This downward force breaks shear pin 34, if present, and moves piston 12 from the run-in position (FIG. 4) to the set position (FIG. 5).

In other embodiments, the actuator devices can be adjustable such that the thermally expansive fluids may be expanded through the application of heat and contracted through the removal of heat. In this manner, the downhole tools can be moved repeatedly from the run-in position, to the set position, and back to the run-in position so that multiple actuations of one or more downhole tools within a tool string can be accomplished without the need from removing the tool string and running additional tool strings. In other words, the same actuator device can be used to actuate more than one downhole tool contained within a tool string disposed within a wellbore. Further, regulation of the expansion of the thermal expansive fluid, such as by regulating the flow of electricity to a thermoelectric device, can be used to provide fractional expansion or contraction of the thermally expansive fluid to precisely position a device such as a downhole choke in intelligent well systems ("IWS") completions.

It is therefore to be understood that the invention is not limited to the exact details of construction, operation, exact materials, or embodiments shown and described, as modifications and equivalents will be apparent to one skilled in the art. For example, the pressure in the lower chamber and, thus, below the seals, may be initially higher than the pressure in the upper chamber so that the piston is urged upward to maintain the downhole tool in its "run-in" position. As is apparent, in such an embodiment, the pressure in the upper chamber as a result of expansion of the thermally expansive fluid must be higher to overcome the pressure in the lower chamber and the area below the seals before the tool can be actuated. Moreover, the heating source may be placed anywhere within the downhole tool provided that heat can be transferred to the thermally expansive fluid sufficiently to cause expansion of the thermally expansive fluid. Accordingly, the invention is therefore to be limited only by the scope of the appended claims.

What is claimed is:

1. An actuator device for a downhole tool, the actuator device being capable of selectively actuating the downhole tool, the actuator device comprising:

a housing having a chamber;

an actuating member carried within the chamber of the housing;

a thermally expansive fluid disposed in the chamber and operatively associated with the actuating member, wherein expansion of the thermally expansive fluid causes a pressure increase within the chamber causing the actuating member to move and, thus, actuate the downhole tool, wherein the actuator device is operatively associated with a breakable membrane such that expansion of the thermally expansive fluid causes the breakable membrane to break causing wellbore fluid to enter the chamber to actuate the actuating member.

2. The actuator device of claim 1, further comprising a heating source in communication with the thermally expansive fluid for elevating a temperature of the thermally expansive fluid, wherein upon increasing the temperature of the thermally expansive fluid the thermally expansive fluid expands causing the pressure increase within the chamber.

3. The actuator device of claim 2, wherein the heating source is a thermoelectric device comprising a heating element activated by electricity flowing through the thermoelectric device, the heating element being disposed within the chamber and in contact with the thermally expansive fluid.

4. The actuator device of claim 3, wherein the heating element is a heating coil.

5. The actuator device of claim 2, wherein the heating source comprises a thermally conductive material.

6. The actuator device of claim 5, wherein the thermally conductive material comprises aluminum.

7. The actuator device of claim 1, further comprising a restraining member mounted to the actuating member for preventing movement of the actuating member until the pressure increase within the chamber is reached.

8. The actuator device of claim 1, wherein the thermally expansive fluid comprises an expandable wax.

9. The actuator device of claim 1, wherein the actuating member comprises a piston carried within the housing and the thermally expansive fluid in the chamber is disposed above the piston for moving the piston downward relative to the housing when the thermally expansive fluid is sufficiently expanded.

10. The actuator device of claim 9, wherein prior to expansion of the thermally expansive fluid, the piston has substantially equal pressures on each of its opposing sides.

11. The actuator device of claim 1, wherein the breakable membrane is a rupture disk.

12. The actuator device of claim 1, wherein the chamber is closed such that expansion of the thermally expansive fluid causes the pressure increase within the chamber to directly actuate the downhole tool.

13. The actuator device of claim 1, wherein the thermally expansive fluid is operatively associated with a restraining member wherein activation of the thermally expansive fluid causes the thermally expansive fluid to expand such that the restraining member no longer restrains movement of the actuating member such that the actuating member is capable of moving, causing actuation of the downhole tool.

14. A downhole tool comprising:

a housing comprising a chamber;

an actuating member comprising a piston disposed within the chamber and operatively associated with the housing, wherein the movement of the actuating member actuates the downhole tool;

a restraining member operatively associated with the actuating member for preventing movement of the actuating member until a pressure within the chamber reaches an actuation pressure level;

a thermally expansive fluid disposed in the chamber above the piston, the thermally expansive fluid being expandable by applying heat to the thermally expansive material;

a heating source in communication with the thermally expansive fluid, the heating source being capable of elevating a temperature of the thermally expansive fluid to expand a volume of the thermally expansive fluid, wherein expansion of the volume of the thermally expansive fluid causes the pressure within the chamber to reach the actuation pressure level causing the actuating member to move and, thus, actuate the downhole tool; and a breakable membrane in fluid communication with the chamber comprising the thermally expansive fluid such that expansion of the thermally expansive fluid causes the breakable membrane to break causing wellbore fluid to enter the chamber to actuate the piston.

15. A method of actuating a downhole tool, the method comprising the steps of:

(a) providing a downhole tool with an actuating member within a chamber, the chamber comprising a thermally expansive fluid on one side of the actuating member;

(b) lowering the tool into a wellbore and contacting the thermally expansive fluid with a heating source capable of causing a temperature of the thermally expansive fluid to increase and, thus, causing a volume of the thermally expansive fluid to increase; and (c) creating a pressure differential across the actuating member due to the increase in the volume of the thermally expansive fluid, causing the actuating member to move and actuate the downhole tool, wherein step (c) is performed by allowing wellbore pressure to access the actuating member to create the pressure differential.

16. The method of claim 15, wherein step (b) is performed by contacting the thermally expansive fluid with a thermoelectric device disposed within the thermally expansive fluid and activating the thermoelectric device to apply heat to the thermally expansive fluid.

17. The method of claim 15, wherein step (b) is performed by placing the downhole tool within a wellbore having a wellbore temperature that heats the heating source and, thus, increases the temperature of the thermally expansive fluid.

* * * * *